US009488408B2

(12) United States Patent
Shelat et al.

(10) Patent No.: US 9,488,408 B2
(45) Date of Patent: Nov. 8, 2016

(54) CONDENSER-REBOILER SYSTEM AND METHOD

(71) Applicants: Maulik R. Shelat, Williamsville, NY (US); Vijayaraghavan S. Chakravarthy, Williamsville, NY (US); Sang Muk Kwark, Williamsville, NY (US)

(72) Inventors: Maulik R. Shelat, Williamsville, NY (US); Vijayaraghavan S. Chakravarthy, Williamsville, NY (US); Sang Muk Kwark, Williamsville, NY (US)

(73) Assignee: PRAXAIR TECHNOLOGY, INC., Danbury, CT (US)

( * ) Notice: Subject to any disclaimer, the term of this patent is extended or adjusted under 35 U.S.C. 154(b) by 285 days.

(21) Appl. No.: 14/167,339

(22) Filed: Jan. 29, 2014

(65) Prior Publication Data

US 2015/0211789 A1 Jul. 30, 2015

(51) Int. Cl.
*F25J 3/04* (2006.01)
*F25J 5/00* (2006.01)

(52) U.S. Cl.
CPC ..... *F25J 5/005* (2013.01); *F25J 3/04412* (2013.01); *F25J 2250/02* (2013.01); *F25J 2250/04* (2013.01); *F25J 2250/10* (2013.01); *F25J 2250/20* (2013.01); *F25J 2290/44* (2013.01)

(58) Field of Classification Search
CPC . F25J 2250/02; F25J 2250/20; F25J 2290/32
USPC ..... 165/111, 114, DIG. 207, DIG. 208
See application file for complete search history.

(56) References Cited

U.S. PATENT DOCUMENTS

| | | | | |
|---|---|---|---|---|
| 946,238 | A | 1/1910 | Loomis | |
| 2,044,372 | A * | 6/1936 | Twomey | F25J 3/04412 165/111 |
| 2,181,704 | A | 11/1939 | McNeal | |
| 2,633,717 | A | 4/1953 | Paget | |
| 3,508,608 | A * | 4/1970 | Roe | C02F 1/043 165/111 |
| 4,436,146 | A | 3/1984 | Smolarek | |
| 4,918,944 | A | 4/1990 | Takahashi et al. | |
| 5,507,356 | A | 4/1996 | Roth et al. | |
| 5,699,671 | A | 12/1997 | Lockett et al. | |
| 5,927,388 | A | 7/1999 | Blangetti et al. | |
| 6,196,023 | B1 | 3/2001 | Corduan et al. | |
| 6,351,968 | B1 | 3/2002 | Habicht et al. | |

(Continued)

FOREIGN PATENT DOCUMENTS

| | | |
|---|---|---|
| DE | 767 216 | 3/1952 |
| DE | 1 551 583 | 6/1970 |
| DE | 1 949 609 | 4/1971 |
| DE | 2 102 976 | 8/1972 |

(Continued)

*Primary Examiner* — John F Pettitt
*Assistant Examiner* — Tareq Alosh
(74) *Attorney, Agent, or Firm* — Robert J. Hampsch

(57) ABSTRACT

A system and method for the concurrent condensation of a nitrogen-rich vapor and vaporization of an oxygen-rich liquid in a distillation column based air separation unit is provided. The disclosed system includes a condenser-reboiler heat exchanger located between a lower pressure column and a higher pressure column and configured to condense a nitrogen-rich vapor from the higher pressure column and partially vaporize an oxygen-rich liquid from the lower pressure column. Within the condenser-reboiler heat exchanger, the nitrogen-rich vapor flows in an upward direction such that any non-condensables present in the nitrogen-rich vapor will accumulate proximate the upper portion or top of the condenser-reboiler modules where they can be easily removed through venting.

8 Claims, 8 Drawing Sheets

(56) References Cited

U.S. PATENT DOCUMENTS

| | | | |
|---|---|---|---|
| 6,393,866 | B1 | 5/2002 | Srinivasan et al. |
| 7,421,856 | B2 | 9/2008 | Chakravarthy et al. |
| 2007/0028649 | A1 | 2/2007 | Chakravarthy et al. |

FOREIGN PATENT DOCUMENTS

| | | | |
|---|---|---|---|
| FR | 2 929 532 | A1 | 10/2009 |
| WO | WO 98/19122 | | 5/1998 |
| WO | WO 99/39143 | | 8/1999 |

* cited by examiner

CONDENSER-REBOILER SYSTEM AND METHOD

FIELD OF THE INVENTION

The present invention relates to a condensation and vaporization system for a distillation column based cryogenic air separation unit. More particularly, the present invention is an improved condenser-reboiler system and method adapted to use an upward flow of nitrogen-rich vapor within the condenser-reboiler to condense the nitrogen-rich vapor and accumulate non-condensables at the top or upper region of the condenser-reboiler.

BACKGROUND

An important aspect of a cryogenic air separation system employing a distillation column is the condensation and vaporization system, and more particularly, the condensation of the higher pressure column vapor against reboiling of the lower pressure column bottom liquid to provide reflux for the columns and to provide an adequate up-flow of vapor through the structured packing in the lower pressure column. The reboiling of liquid oxygen is performed by heat exchange with nitrogen vapor from the top of the higher pressure column. During the heat exchange process, the nitrogen vapor is condensed, and at least some of the condensate is returned to the higher pressure column to act as a source of reflux for the higher pressure column. In some condenser-reboiler configurations, the heat exchange between the boiling liquid oxygen and the condensing nitrogen is carried out in a shell and tube heat exchanger with the liquid oxygen typically flowing within the tubes of the heat exchanger while the higher pressure column top vapor is processed on the shell side of the heat exchanger. Such shell and tube heat exchangers offer the advantage of improved operating characteristics from a safety perspective. Compactness of the shell and tube heat exchanger is achieved by having enhanced boiling and condensing surfaces, as generally described in U.S. Pat. Nos. 7,421,856; 6,393,866; and 5,699,671 as well as U.S. published patent application No. 2007/0028649.

There are two main types of heat exchangers used in the condensing-reboiling process including a thermosyphon type heat exchanger and a downflow heat type exchanger. In a thermosyphon type heat exchanger, the liquid oxygen liquid enters the tubes at the bottom and is vaporized as it passes up the tubes. In a downflow heat exchanger, the liquid oxygen liquid is vaporized as it flows downwardly within the tubes. While both of these configurations ensure safe operation of the oxygen vaporization process, both of these configurations also have certain disadvantages.

Other problems that diminish the thermal performance of the condenser-reboiler and, in turn, adversely affect the energy efficiency and operating costs of the cryogenic air separation unit are the accumulation of non-condensables in the main condenser-reboiler. The non-condensables, such as neon and helium, are present in very small quantities in air, but the accumulation of the non-condensables within a main condenser-reboiler results in a higher resistance to targeted heat transfer requiring a higher bulk temperature difference between the condensing nitrogen and boiling oxygen. As indicated above, the higher bulk temperature difference between the condensing nitrogen and boiling oxygen translates to a higher pressure requirement for the incoming nitrogen vapor which ultimately results in higher compression power and associated costs for the air separation unit.

Unless the non-condensables are removed from the main condenser-reboiler cold heat exchange surfaces, the top temperature difference between the condensing nitrogen and boiling oxygen could be higher.

In addition, since the non-condensables tend to aggregate or accumulate on the heat transfer surfaces of the main condenser-reboiler where the bulk vapor velocities are lower, the high concentration zones of non-condensables in many current designs are dispersed throughout the main condenser-reboiler such that it becomes difficult to collect and remove them, which for some of the non-condensables such as neon which has significant commercial value, it cannot be recovered in a cost effective manner.

Accordingly, there is a need for an improved condensation and vaporization system which can be effectively employed to condense nitrogen vapor and vaporize liquid oxygen in a cryogenic air separation unit that does not suffer from the above-identified disadvantages.

SUMMARY OF THE INVENTION

The present invention is an improved tube and shell type condenser-reboiler system and method for use in cryogenic air separation units and adapted to use an upward flow of a condensing medium such as a nitrogen-rich vapor or air vapor within the condenser reboiler to and thereby accumulate non-condensables at the top or upper region of the condenser-reboiler. The condensing medium may be introduced to the module in most any location, including bottom, top or sides but is released into the shell proximate the lower portion or bottom of the shell to initiate the generally upward flow of the condensing medium, while the condensate flows downward and is removed near the bottom of the shell.

Specifically, the present invention may be characterized as a condensation and vaporization system for a distillation column based air separation unit comprising: (i) one or more condenser-reboiler modules disposed between a lower pressure column and a higher pressure column and configured to receive a condensing medium at a condensing medium inlet, and an oxygen-rich liquid from the lower pressure column at an oxygen-rich liquid inlet; (ii) a heat exchanger disposed in the condenser-reboiler modules and configured to partially vaporize the oxygen-rich liquid to form an oxygen-rich effluent and condense the condensing medium to form a condensate; and (iii) one or more vents disposed proximate the upper portion or top of the housing and configured to remove the accumulated non-condensables from within the one or more condenser-reboiler modules. The condensing medium flows in an upward and radially outward direction within the condenser-reboiler modules such that any non-condensables present in the condensing medium will accumulate proximate the upper portion or top of the condenser-reboiler modules. The condenser-reboiler modules further include a condensate outlet proximate the bottom of the module and an oxygen-rich effluent outlet.

The heat exchanger may be a shell and tube heat exchanger comprising two opposed tube sheets, a cylindrical shell connecting the two opposed tube sheets, and a plurality of tubes extending therebetween for indirectly exchanging heat between the oxygen-rich liquid flowing within the plurality of tubes and the condensing medium flowing upward within the cylindrical shell. The heat exchanger may be a thermosyphon type heat exchanger with the oxygen-rich liquid inlet disposed proximate the bottom of the condenser-reboiler module and the oxygen-rich effluent outlet is disposed proximate the top.

Alternatively, the heat exchanger may be a downflow type heat exchanger where the oxygen-rich liquid inlet is disposed proximate the top of the condenser-reboiler module and the oxygen-rich effluent outlet is disposed proximate the bottom of the condenser-reboiler module. In the case of a downflow type heat exchanger, the oxygen-rich liquid may be pumped from the bottom of the lower pressure column to the top or upper portion of the condenser-reboiler module for re-boiling or the oxygen-rich liquid may be collected from the descending liquid in the lower pressure column using a collector disposed above the top of the condenser-reboiler module where it can be supplied to the top or upper portion of the condenser-reboiler module for re-boiling.

The condenser-reboiler module may be configured in a variety of arrangements including one embodiment where the condensate outlet is disposed proximate the bottom of the condenser-reboiler module and concentrically around the condensing medium or nitrogen-rich vapor inlet. Another embodiment provides the condensate outlet proximate the bottom of the condenser-reboiler module but near the lateral side or peripheral edges of the housing. Still further, multiple condensate outlets may be provided including a centrally disposed and a peripherally disposed outlet.

Still other embodiments of the present condenser-reboiler contemplate providing an impingement plate or baffle plates centrally disposed in a lower portion or upper portion of the condenser-reboiler module. The impingement plate or baffle plates are configured to radially deflect the upward flow of the condensing medium (e.g. nitrogen-rich vapor or air vapor) to enhance the dispersion of the condensing medium to the condensing surfaces and also minimize possible bypass flow through axial direction. Alternatively, some embodiments of the condenser-reboiler modules may include a distributor structure centrally disposed in a lower portion of the condenser-reboiler module and configured to radially distribute the flow of the condensing medium to disperse the nitrogen-rich vapor to the condensing surfaces. The condensing medium inlet may be disposed at the top or the lateral sides of the condenser-reboiler module and directed via a conduit to the perforated distributor structure where the upward flow of the nitrogen-rich vapor is initiated. Alternatively, the condensing medium inlet may be disposed at the bottom of the condenser-reboiler module where the upward and radially outward flow of the condensing medium is initiated as soon as it enters the housing or shell.

The present invention may further include one or more vents disposed proximate the top of the condenser-reboiler modules. The vents are configured to and continuously remove the accumulated non-condensables from within the one or more condenser-reboiler modules. The one or more vents may be centrally disposed proximate the top of the condenser-reboiler module or proximate the lateral side or peripheral edges of the condenser-reboiler module housing or both. Upon removal from the condenser-reboiler modules, the non-condensables may be separated and purified in order to recover selected non-condensable gases.

The present invention may also be characterized as a method for carrying out cryogenic air separation comprising the steps of: (i) separating feed air within a higher pressure column by cryogenic rectification to produce a nitrogen-rich vapor and an oxygen enriched fluid, passing oxygen enriched fluid from the higher pressure column into a lower pressure column, and producing by cryogenic rectification an oxygen-rich liquid within the lower pressure column; (ii) directing the oxygen-rich liquid a condensing medium to one or more condenser-reboiler modules having a plurality of vertically oriented tubes; (iii) partially vaporizing the oxygen-rich liquid through the plurality of vertically oriented tubes in the one or more condenser-reboiler modules; (iv) releasing the condensing medium proximate the bottom of the one or more condenser-reboiler modules so as to flow in a generally upward and radial outward direction through the one or more condenser-reboiler modules and in contact with the exterior surfaces of the vertically oriented tubes to condense the condensing medium (e.g., nitrogen-rich or air vapor) by indirect heat exchange with the partially vaporizing oxygen-rich liquid and produce a condensate and an oxygen-rich effluent wherein non-condensables present in the condensing medium, accumulate proximate an upper portion or top of the one or more condenser-reboiler modules; and (v) opening one or more vents disposed proximate the upper portion or top of the one or more condenser-reboiler modules to remove the accumulated non-condensables from within the one or more condenser-reboiler modules.

BRIEF DESCRIPTION OF THE DRAWINGS

While the specification concludes with claims distinctly pointing out the subject matter that applicants regard as their invention, it is believed that the invention will be better understood when taken in connection with the accompanying drawings in which:

For the sake of avoiding repetition, some of the common elements in the various Figures utilize the same numbers where the explanation of such elements would not change from Figure to Figure.

DETAILED DESCRIPTION

Figure 2:
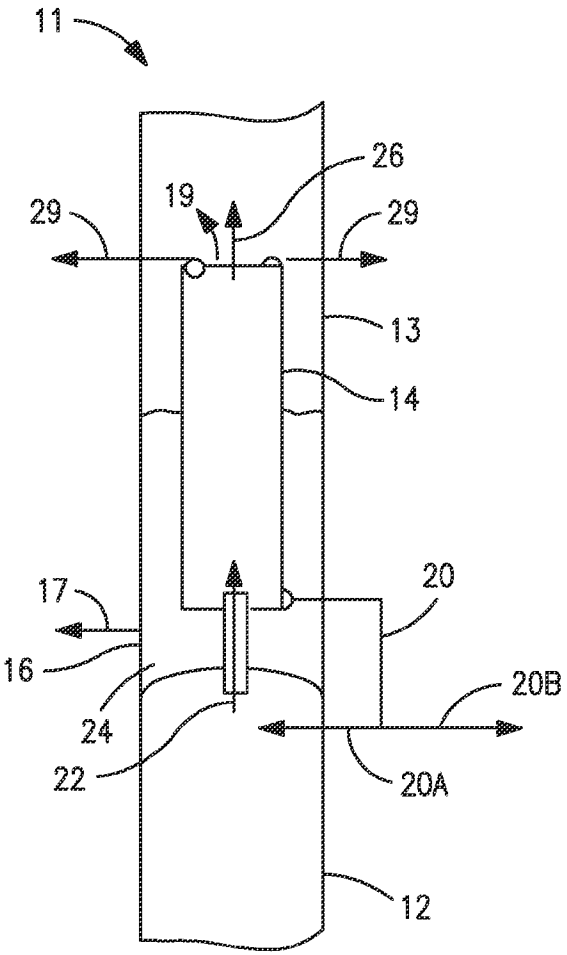
FIG. 2 is another schematic illustration of a distillation column arrangement in an air separation unit depicting condenser-reboiler in a thermosyphon type arrangement for boiling of a liquid oxygen stream and up-flow of the nitrogen vapor in accordance with an alternate embodiment of the present invention.
Figure 1:
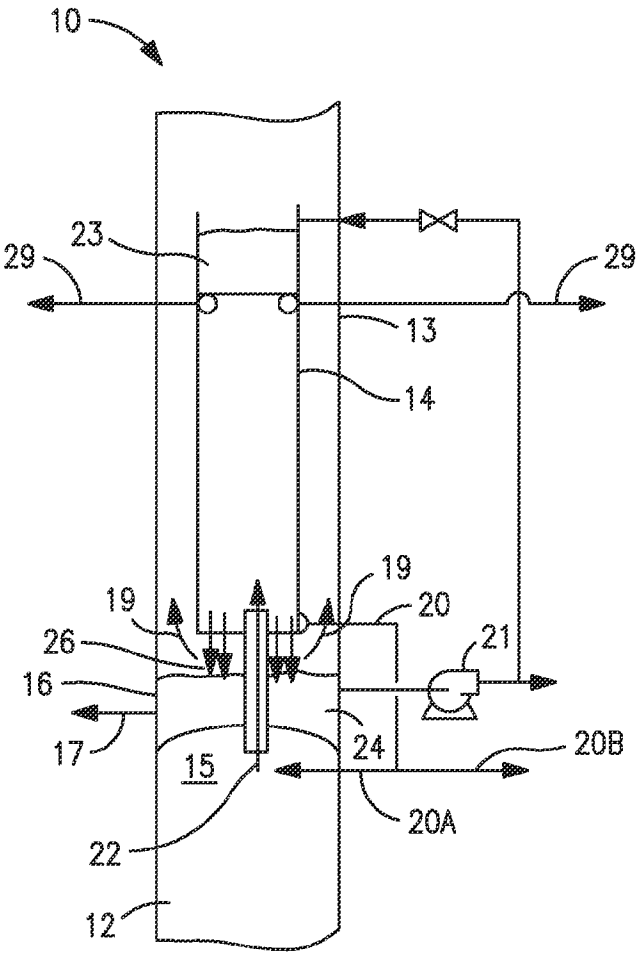
FIG. 1 is a schematic illustration of a distillation column arrangement in an air separation unit depicting the condenser-reboiler in a downflow type arrangement for boiling of a liquid oxygen stream and up-flow of the nitrogen vapor in accordance with an embodiment of the present invention.
Figure 4:
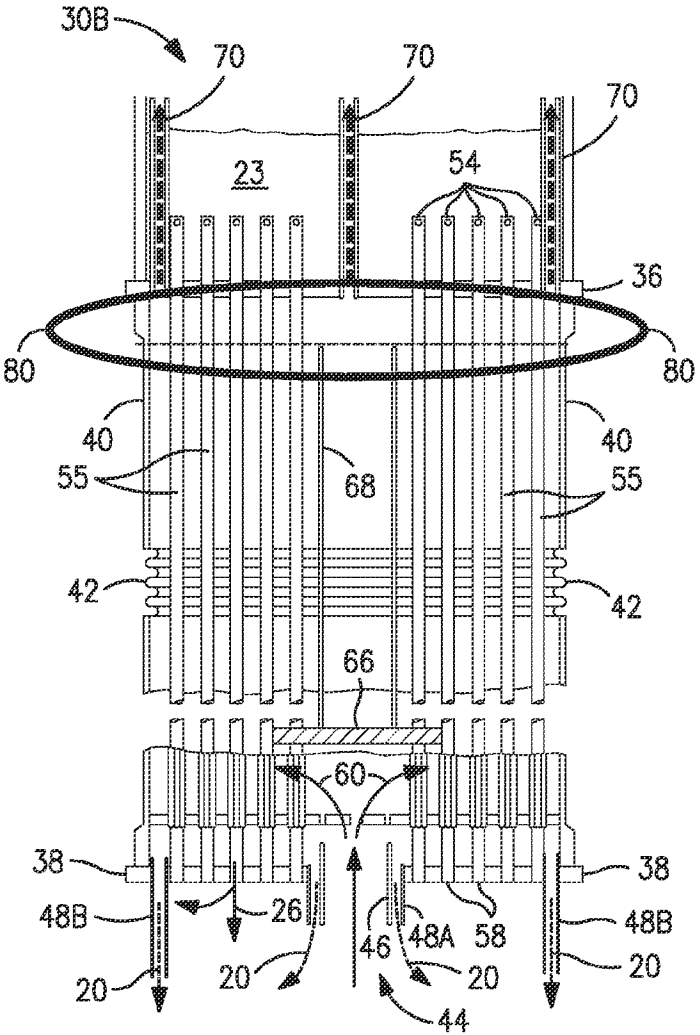
FIG. 4 is an elevational sectional view of yet another embodiment of the condenser-reboiler module with a downflow type arrangement for boiling of a liquid oxygen stream and up-flow of the nitrogen-rich vapor.
Figure 3:
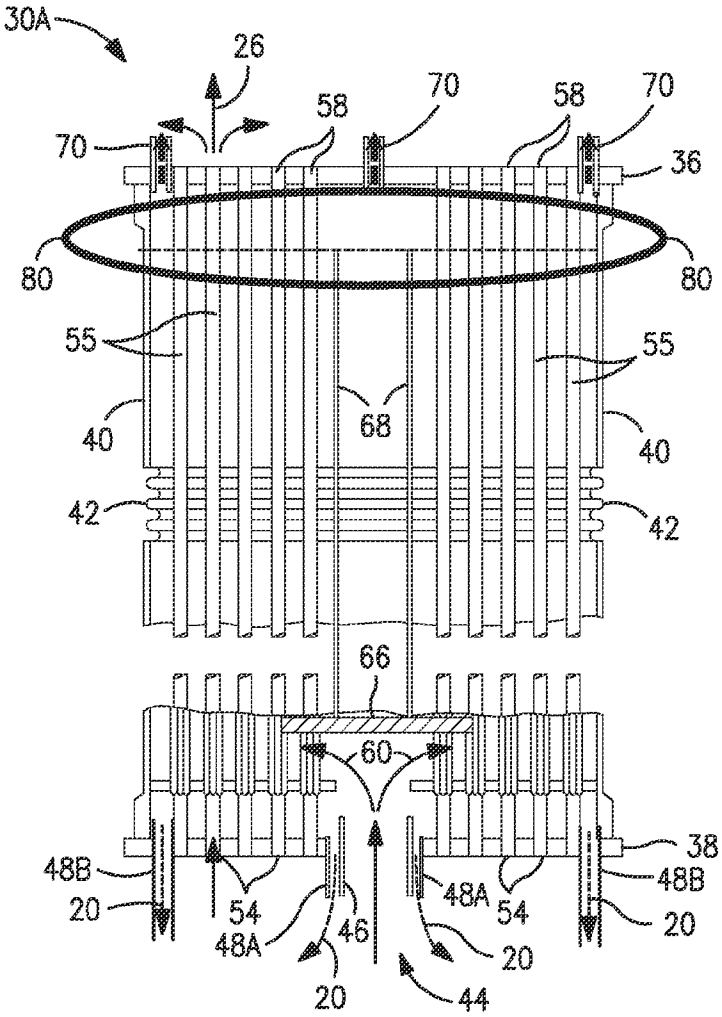
FIG. 3 is an elevational sectional view of yet another embodiment of the condenser-reboiler module with a thermosyphon type arrangement for boiling of a liquid oxygen stream and up-flow of the nitrogen-rich vapor.

Turning now to FIG. 1 and FIG. 2, there is shown a schematic illustration of a distillation column arrangement in an air separation unit depicting a typical condenser-reboiler module with up-flow of the condensing medium such as nitrogen vapor or air vapor. FIG. 1 shows the present condenser-reboiler with up-flow of the nitrogen vapor configured as a downflow type heat exchanger whereas FIG. 2 shows the present condenser-reboiler with up-flow of the nitrogen vapor configured as a thermosyphon type heat exchanger.

The distillation column arrangements 10 and 11 each have a higher pressure distillation column 12 and a lower pressure distillation column 13 and a main condenser-reboiler module 14 coupling the higher and lower pressure distillation columns in a heat transfer relationship. The distillation column arrangements 10 and 11 are specifically designed to conduct a distillation process in connection. Distillation column arrangements 10 and 11 are used in the separation to produce nitrogen and oxygen enriched products. Although not illustrated, as also well known, in an air separation unit (ASU), incoming air is compressed, purified and cooled to a temperature suitable for its rectification. The purified and cooled air is then introduced into the higher pressure distillation column 12 where an ascending vapor phase is contacted with the descending liquid phase by known mass transfer contacting elements which can be structured packing, random packing or sieve trays or a combination of such packing and trays. The ascending vapor phase of the air becomes rich in nitrogen as it ascends and a descending liquid phase becomes rich in oxygen. As a result, a bottoms liquid known as crude liquid oxygen or kettle liquid collects in the bottom of the higher pressure column 12 and a nitrogen-rich vapor 15 collects in the top or upper portion of the higher pressure column 12.

A stream of the nitrogen-rich vapor 22 is introduced into an inlet conduit 24 that is coupled to the condenser-reboiler module 14 near the bottom. Alternatively, the nitrogen rich stream may be introduced to the condenser-reboiler module near the top or side of the module and released within the shell at or near the bottom of the shell. As will be discussed in more detail below, the nitrogen-rich vapor 22 released within the shell flows in a generally upward direction within the condenser-reboiler shell and indirectly exchanges heat with the oxygen-rich liquid in the condenser-reboiler tubes to partially vaporize the oxygen liquid and to condense the nitrogen-rich vapor 22. In the embodiment of FIG. 1, the oxygen-rich liquid taken from the column bottoms 16 may be circulated via pump 21 from the bottom of the lower pressure column to the top or uppermost portion of the condenser-reboiler module 14 where it is collected as 23 and descends within the condenser-reboiler tubes in a downflow type heat exchanger arrangement. Vaporization of the oxygen-rich liquid produces a two phase oxygen-rich effluent stream 26 that exits proximate the bottom of the condenser-reboiler module 14. The stream may be extracted as oxygen product or may become part of the ascending vapor phase 19 within lower pressure distillation column 13. Any oxygen liquid that is not vaporized returns to the bottom of the lower pressure distillation column 13 and the oxygen-rich liquid column bottoms 16.

Alternatively, in the embodiment of FIG. 2, the oxygen-rich liquid taken from the column bottom 16 may ascend within the condenser-reboiler tubes by the thermosyphon effect, discussed above. The vaporization of the oxygen-rich liquid produces an oxygen-rich effluent stream 26 that forms part of the ascending vapor phase 19 within lower pressure distillation column 13 as the partially vaporized oxygen-rich effluent stream 26 exits the condenser-reboiler module 14. Any oxygen liquid that is not vaporized may return to the bottom of the lower pressure distillation column 13 and the oxygen liquid column bottoms 16.

In both embodiments shown in FIG. 1 and FIG. 2, the resulting condensate 20 that consists of nitrogen-rich liquid is discharged from the bottom of the condenser-reboiler module 14. A first portion of the condensate 20A is coupled to the higher pressure column 12 to be used as a reflux stream comprised of the nitrogen-rich liquid. A part of the second portion of the condensate 20B is coupled to the lower pressure column 13 while another part of such stream 20B could be taken as a liquid product or pumped and heated, taken as a pressurized product. Preferably, a liquid distributor (not shown) is provided within the top portion of the higher pressure column 12 and the top portion of the lower pressure column 13 to collect the nitrogen-rich reflux, 20A and 20B respectively, and distribute the reflux streams to mass transfer contacting elements.

The advantages provided by the above-described embodiments relate to lower operating costs that may be realized as a result of improvements in thermal efficiency of the main condenser which translates to power savings as well as potential capital savings during the construction of an air separation unit. The improvements in thermal efficiencies may be achieved through the enhanced separation and removal of accumulated non-condensables such as neon and helium by discharging vent streams 29 from the condenser-reboiler 14.

Neon and helium are present in very small quantities in air, roughly 18 ppm for neon and about 5 ppm for helium. These non-condensables tend to concentrate at much higher levels in the main condenser of an air separation unit as the nitrogen-rich vapor condenses and is removed to form the reflux streams. These concentrated non-condensables also tend to accumulate or aggregate at or near the cold heat transfer surfaces particularly in regions or locations within the condenser-reboiler modules away from the nitrogen-rich vapor inlet where the bulk nitrogen-rich vapor velocities are lower. Accumulation or aggregation of the non-condensables may result in a higher resistance to heat transfer occurring within the condenser-reboiler modules which in turn requires a higher bulk temperature difference between the condensing nitrogen and boiling oxygen. The higher bulk temperature difference drives the need for increased pressure of the higher pressure column from which the nitrogen-rich vapor originates which ultimately results in higher compression power for the air separation unit.

In the above-described embodiments, the nitrogen-rich vapor is introduced via an inlet that causes the flow of the nitrogen-rich vapor in a generally upward and somewhat radial direction through the condenser-reboiler modules. Using this upward and radial flow arrangement and against gravity, non-condensables such as neon and helium that are present in the nitrogen-rich vapor will tend to accumulate near the top or uppermost portion of the condenser-reboiler modules (See region 80 in FIGS. 3-16). During the condensation, the vapor continues to flow upward whereas the condensate flows in the opposite direction which permits an increasing vapor non-condensable concentration gradient which should lead to increased separation and higher condensation heat transfer. In addition, in the embodiments where the nitrogen-rich vapor from top of the higher pressure column is fed straight into the lower portion or bottom of the main condenser-reboiler, the pressure drop could be reduced compared to prior art designs.

Also, by accumulating the non-condensables near the top or uppermost portion of the condenser-reboiler modules, they are more easily collected and removed by venting the non-condensables resulting in enhanced performance of condenser-reboiler modules. Equally important is that easy collection and removal of the non-condensables, such as neon and helium facilitates the separation, purification and recovery of selected high value gases, such as neon.

As described in more detail below, venting of the non-condensables is achieved by providing one or more vents and associated vent control valves (not shown) disposed proximate the top of the condenser-reboiler modules where the non-condensables are accumulating or aggregating. Through control of the vent control valves, the accumulated non-condensables are purged or removed from the condenser-reboiler module. Preferably, the vents are centrally disposed at the top of the condenser-reboiler module or at the top of the condenser-reboiler module proximate the lateral side or peripheral edge. It may also be advantageous to place multiple vent locations on each condenser-reboiler module, including both centrally disposed and peripherally disposed vents.

Unlike many prior art designs, which separates the location of the nitrogen-rich vapor feed manifold and the liquid nitrogen condensate manifold, the present system allows for the feed and condensate manifolds to be co-located. Co-locating the nitrogen-rich vapor feed to the condenser-reboiler modules with the liquid nitrogen condensate collection point at or below the bottom of the condenser-reboiler modules results in a reduction the net manifolding volume associated with the main condenser and increases the overall thermal performance of the condenser-reboiler modules. Reducing the net manifolding volume and co-locating the nitrogen-rich vapor feed manifold with the liquid nitrogen condensate manifold below the bottom of each condenser-reboiler module allows for the reduction in column height and associated capital expense.

In many of the prior art condenser-reboiler designs, a plurality of condenser-reboiler modules are often fed by a single internal or external nitrogen-rich vapor pipe which moves the nitrogen-rich vapor from the upper portion of the higher pressure column to a point above the condenser-reboiler modules. The transported nitrogen-rich vapor flow is then split and fed into the top of each condenser-reboiler module where it flows in a downward orientation contacting the condensing surfaces. Liquid nitrogen condensate is collected at the bottom of each condenser-reboiler module before being combined into a single condensate manifold or pipe. Regardless of the routing, the nitrogen-rich vapor feed manifold in most of the current condenser-reboiler designs takes up significant space above the assembly, which increases column height, complexity and expense.

Turning now to FIGS. 3, 4, 11, 12, 13, 14, 15, 16, there is shown various embodiments of the present condenser-reboiler module 14. In all illustrated embodiments, the condenser-reboiler module 14 includes a shell and tube heat exchanger 30A, 30B that is provided with two opposed tube sheets 36 and 38. A cylindrical shell 40 connects the tube sheets 36 and 38. A bellows-like expansion joint 42 can be provided for purposes of differential expansion. A plurality of vertically oriented tubes extending between the two opposed tube sheets are arranged for indirectly exchanging heat between the oxygen-rich liquid flowing within the plurality of tubes and the condensing medium, such as a nitrogen-rich vapor or air vapor, flowing upward within the cylindrical shell 40. Tube sheet 38 is provided with a central nitrogen-rich vapor or condensing medium inlet 44 to allow the condensing medium to enter the shell 40. An inlet pipe 46 can be connected to the tube sheet 38 to facilitate flow of the condensing medium through with the central condensing medium inlet 44 into the interior spaces of the shell 40. Although not shown, inlet pipe 46 is also connected to the upper portion of the higher pressure column where the supply of the condensing medium, and more particularly, nitrogen-rich vapor is found.

Figure 12:
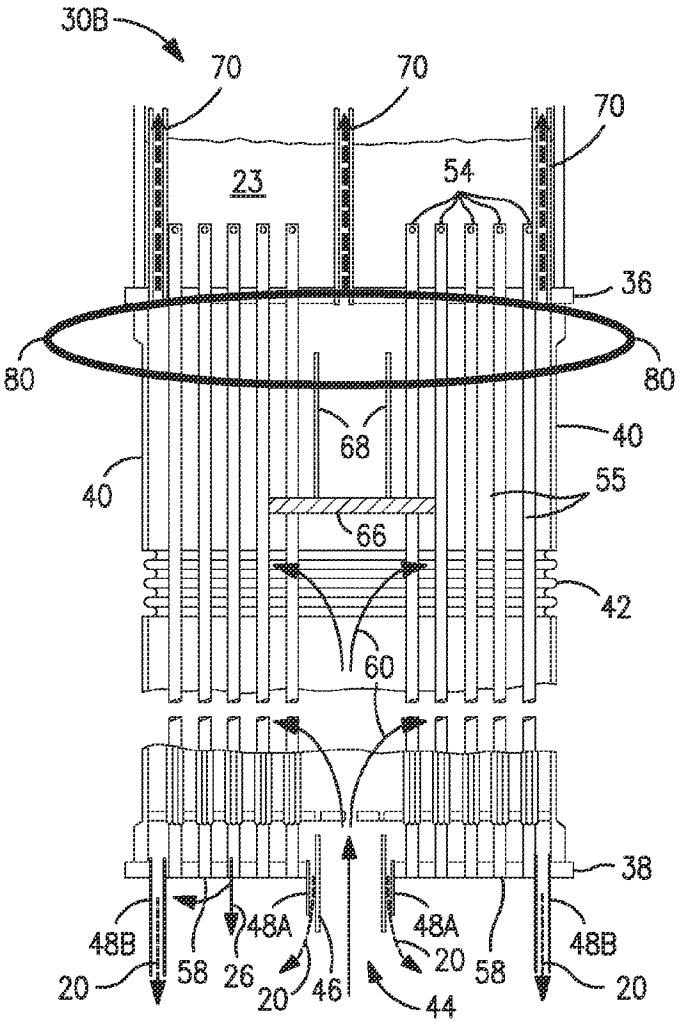
FIG. 12 is an elevational sectional view of another embodiment of the condenser-reboiler module with a downflow type arrangement for boiling of a liquid oxygen stream and up-flow of the nitrogen vapor.
Figure 14:
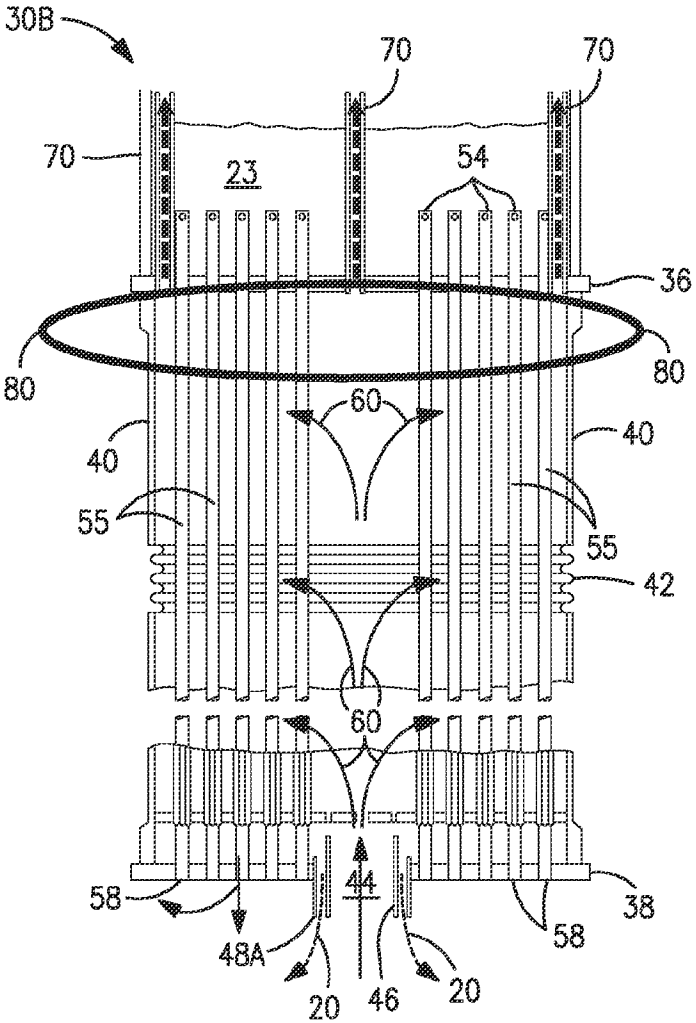
FIG. 14 is an elevational sectional view of an embodiment of condenser-reboiler module with a downflow type arrangement for boiling of a liquid oxygen stream and up-flow of the nitrogen vapor in accordance with the present invention.
Figure 13:
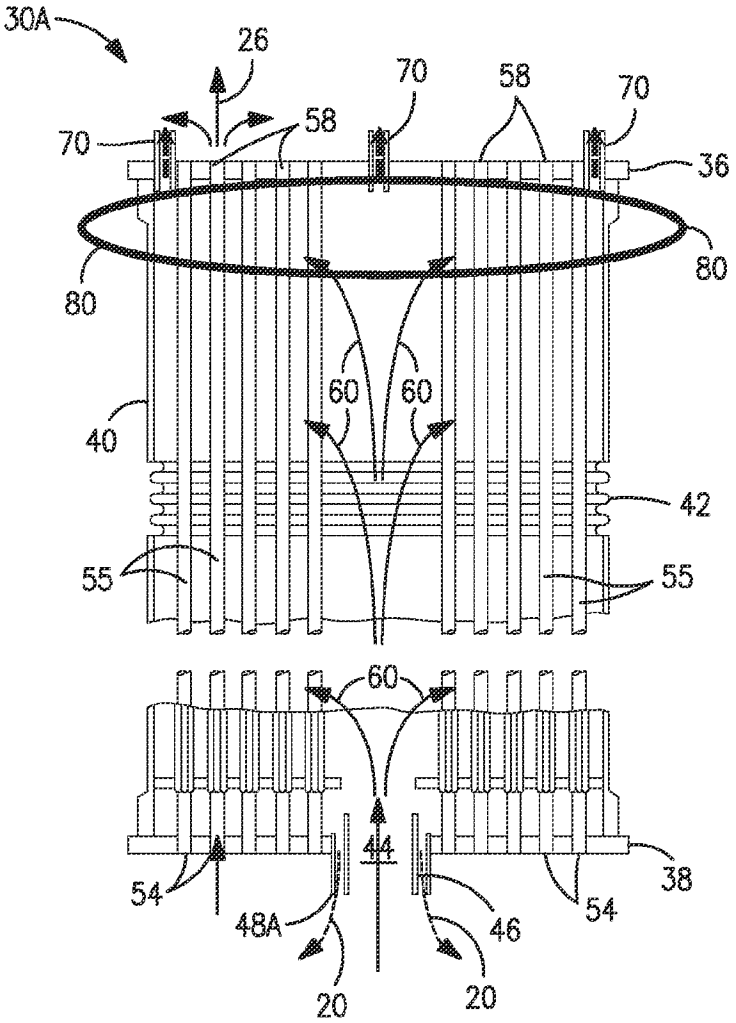
FIG. 13 is an elevational sectional view of an embodiment of condenser-reboiler module with a thermosyphon type arrangement for boiling of a liquid oxygen stream and up-flow of the nitrogen vapor in accordance with the present invention.
Figure 16:
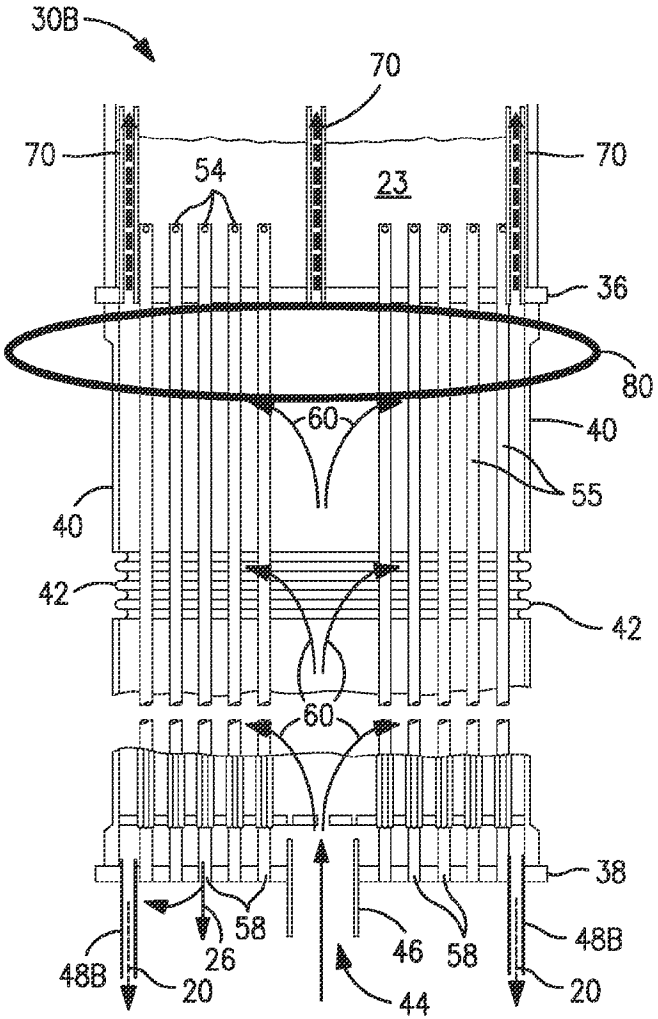
FIG. 16 is an elevational sectional view of an alternate embodiment of the condenser-reboiler module with a downflow type arrangement for boiling of a liquid oxygen stream and up-flow of the nitrogen vapor.
Figure 15:
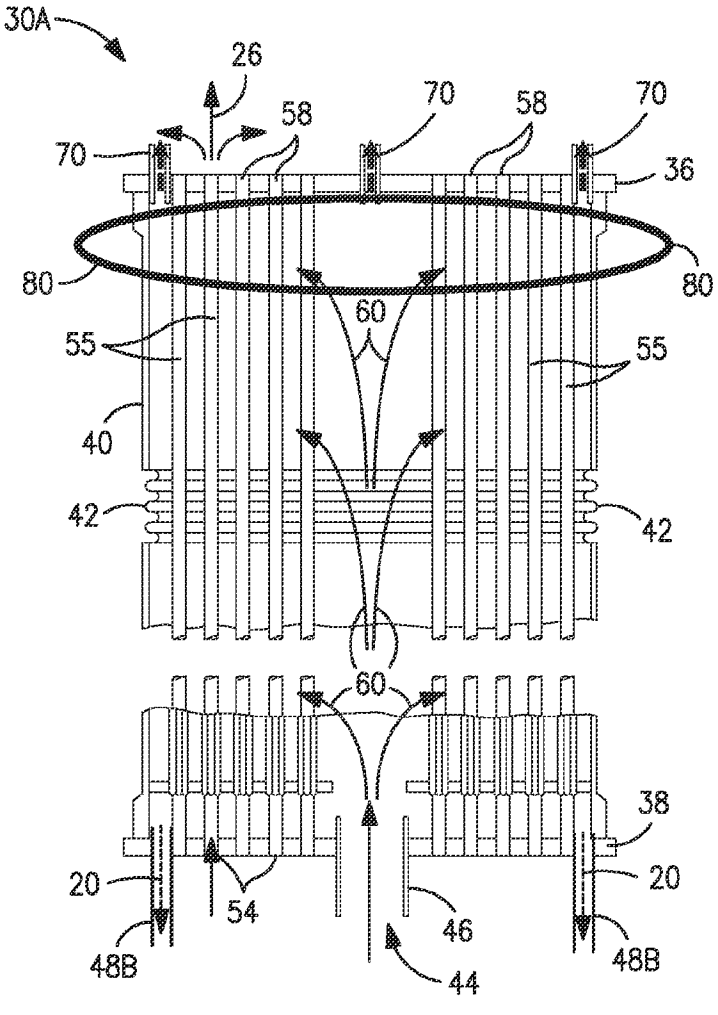
FIG. 15 is an elevational sectional view of an alternate embodiment of the condenser-reboiler module with a thermosyphon type arrangement for boiling of a liquid oxygen stream and up-flow of the nitrogen vapor.

A condensate outlet 48 is provided in the tube sheet 38 for discharging the condensate 20 produced by condensing the nitrogen-rich vapor and thereby forming the nitrogen-rich liquid to be used as reflux streams 20A, 20B for the higher pressure column and lower pressure column, respectively. Additionally, such stream 20B could be taken as a liquid product or pumped and heated, and taken as a pressurized product. In FIG. 13 and FIG. 14, the condensate outlet 48 is centrally disposed at the bottom of the condenser-reboiler module concentrically with respect to the condensing medium inlet 44. In FIG. 15 and FIG. 16, the condensate outlet 48 is disposed at the bottom of the condenser-reboiler module 14 but closer to the edge or periphery of the condenser-reboiler module 14. FIGS. 3, 4, 11, and 12 show embodiments with multiple condensate outlets 48, including a centrally disposed condensate outlet 48A and peripherally disposed condensate outlet 48B both located at or near the bottom of condenser-reboiler module 14.

FIGS. 3, 5, 7, 9, 11, 13 and 15 show a thermosyphon type heat exchanger 30A where the oxygen-rich liquid inlets 54 are associated with each of the vertically oriented tubes 55 and disposed proximate the bottom of the condenser-reboiler module 14. Similarly, the oxygen-rich effluent outlets 58 are associated with each of the vertically oriented tubes 55 and disposed proximate the top of the condenser-reboiler module 14. In these embodiments, the oxygen-rich liquid at the bottom of the lower pressure column is supplied to the oxygen-rich liquid inlets 54 for re-boiling within the heat exchanger 30A.

FIGS. 4, 6, 8, 10, 12, 14 and 16 show a downflow type heat exchanger 30B where the oxygen-rich liquid inlets 54 are disposed at one end of the vertically oriented tubes 55 proximate the top of the condenser-reboiler module 14 and tubesheet 36 whereas the oxygen-rich effluent outlet 58 is disposed the other end of the tubes 55 at or near the bottom of the condenser-reboiler module 14 and tubesheet 38. In these embodiments, the oxygen-rich liquid at the bottom of the lower pressure column is supplied to the oxygen-rich liquid inlets 54 for re-boiling within the heat exchanger 30B.

Figure 11:
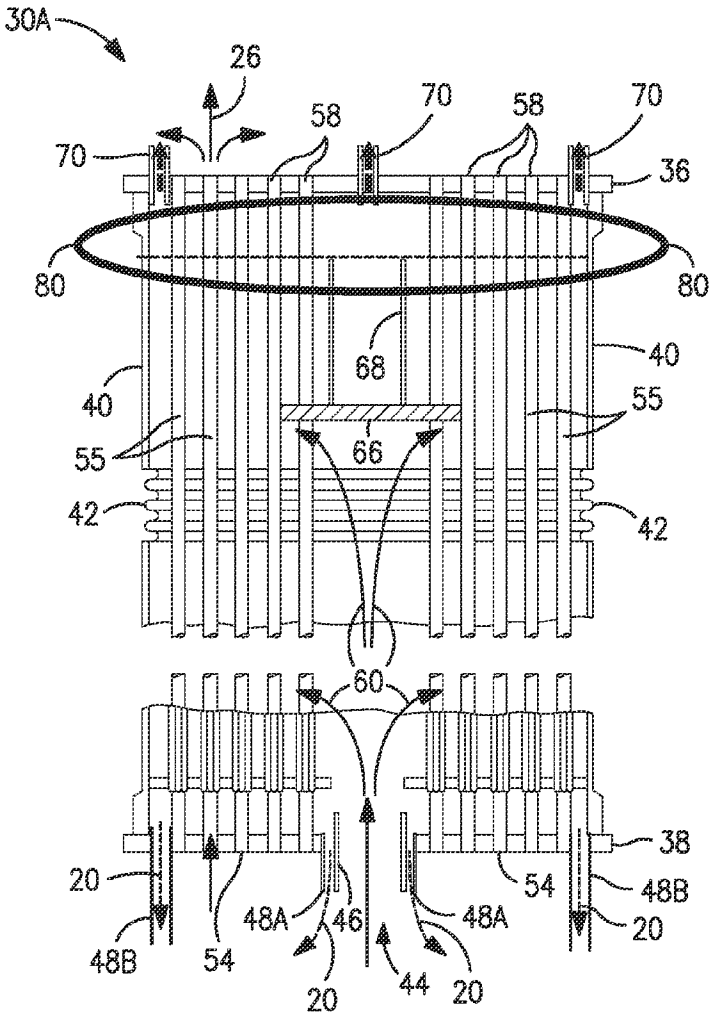
FIG. 11 is an elevational sectional view of another embodiment of condenser-reboiler module with a thermosyphon type arrangement for boiling of a liquid oxygen stream and up-flow of the nitrogen vapor.

In all the illustrated embodiments, the tubes 55 are preferably all of the same design and diameter. It is to be noted that all of the tubes 55 could be provided with an outer fluted surface and the interior of the tubes could be provided with an enhanced boiling surfaces. A condensing medium such as nitrogen-rich vapor enters each of the condenser-reboiler modules 14 through the central condensing medium inlet 44 and then flows in an upward and radially outward direction as suggested by arrows 60. As seen in FIGS. 3, 4, 11, and 12, the condenser-reboiler modules 14 may also include a centrally disposed impingement plate 66 that will also have an effect of urging the incoming condensing medium or nitrogen-rich vapor flow in the outward radial direction. The impingement plate 66 is connected to the tubesheet 36 or to the vertically oriented tubes 55 by means of a set of supports 68. In FIGS. 11 and 12, the impingement plate is located in an upper portion of the heat exchanger 30A, 30B whereas in FIGS. 3 and 4, the impingement plate is located in a lower portion of the of the heat exchanger 30A, 30B and within the shell 40. Either way, the impingement plate 66 is configured to deflect the upward flow of the condensing medium (e.g. nitrogen-rich vapor or air vapor) and radially disperse the condensing medium to the condensing surfaces within the shell 40, namely the exterior surfaces of the tubes 55.

Figure 6:
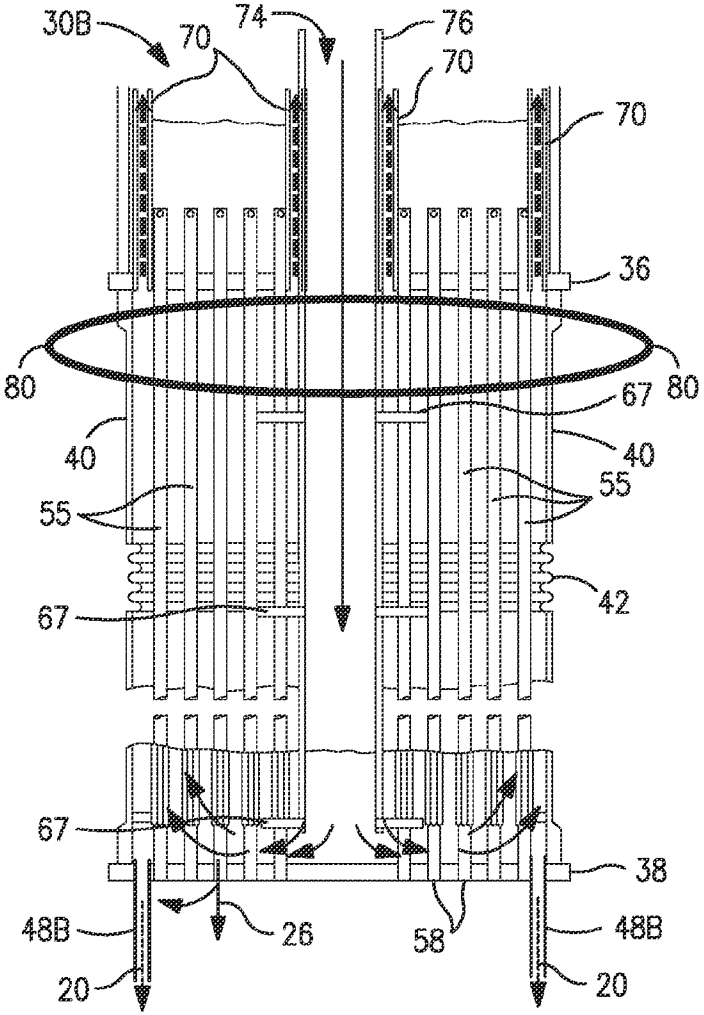
FIG. 6 is an elevational sectional view of yet another embodiment of the condenser-reboiler module with a downflow type arrangement for boiling of a liquid oxygen stream and generally upward flow distribution of the nitrogen-rich vapor.
Figure 5:
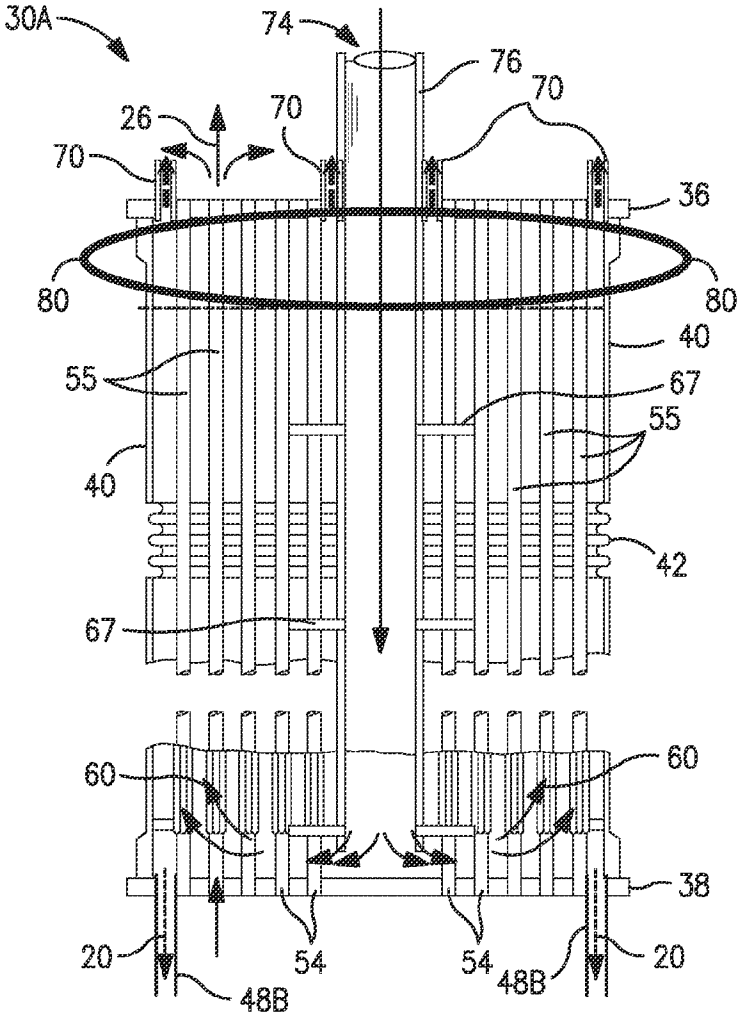
FIG. 5 is an elevational sectional view of yet another embodiment of the condenser-reboiler module with a thermosyphon type arrangement for boiling of a liquid oxygen stream and generally upward flow distribution of the nitrogen-rich vapor.
Figure 8:
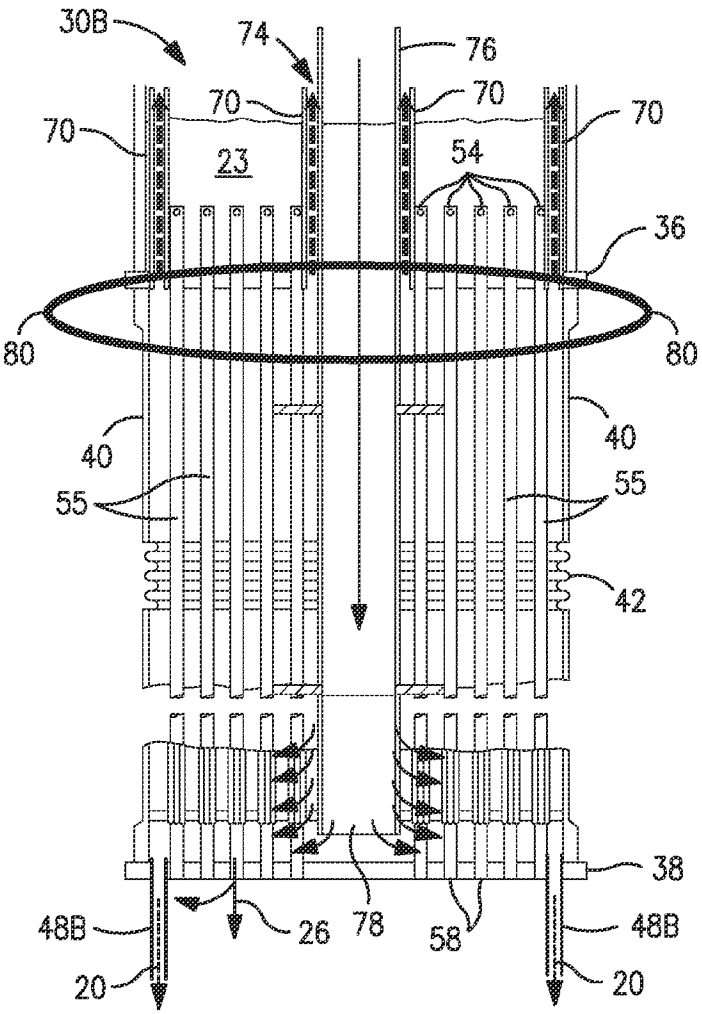
FIG. 8 is an elevational sectional view of yet another embodiment of the condenser-reboiler module with a downflow type arrangement for boiling of a liquid oxygen stream and generally upward flow distribution of the nitrogen-rich vapor with perforated distributor.
Figure 7:
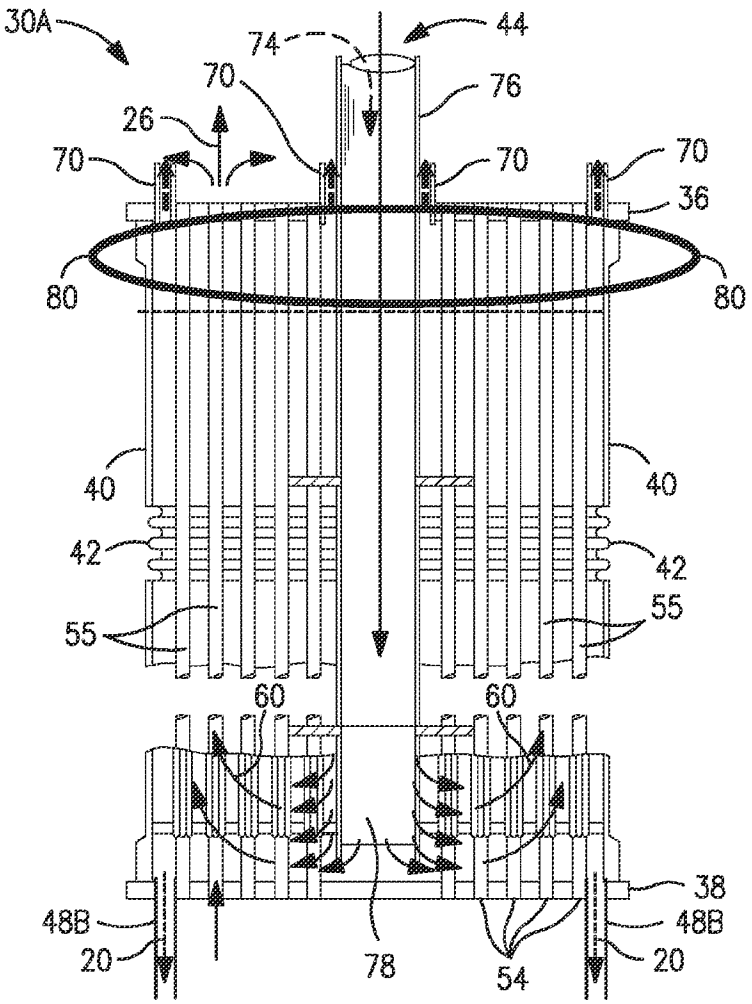
FIG. 7 is an elevational sectional view of yet another embodiment of the condenser-reboiler module with a thermosyphon type arrangement for boiling of a liquid oxygen stream and generally upward flow distribution of the nitrogen-rich vapor with perforated distributor.

Turning now to FIG. 5 and FIG. 6, there is shown yet another embodiment of the thermosyphon type heat exchanger 30A and downflow type heat exchanger 30B, respectively. These two embodiments differ from the previously discussed embodiments in that the condensing medium inlet 74 is not located at or near the bottom of the condenser-reboiler module 14 and tubesheet 38 but rather at or near the top of the condenser-reboiler module 14 and tubesheet 36. Although not shown, alternative embodiments also contemplate locating the condensing medium inlet at or near the side or periphery of the shell 40. The condensing medium, preferably nitrogen-rich vapor, is directed from the upper portion of the higher pressure column via inlet conduit 76 within the shell 40 towards the lower portion of the heat exchanger 30A, 30B. At the end of the inlet conduit 76 the flow of condensing medium or nitrogen-rich vapor is released and is radially dispersed within the shell 40. For further improvement of flow distribution of condensing vapor, the perforated structures can be used at the bottom of inlet conduit 76 in FIG. 7 and FIG. 8. Upon dispersion, the condensing medium will flow in the generally upward and radially outward direction to the condensing surfaces.

Figure 10:
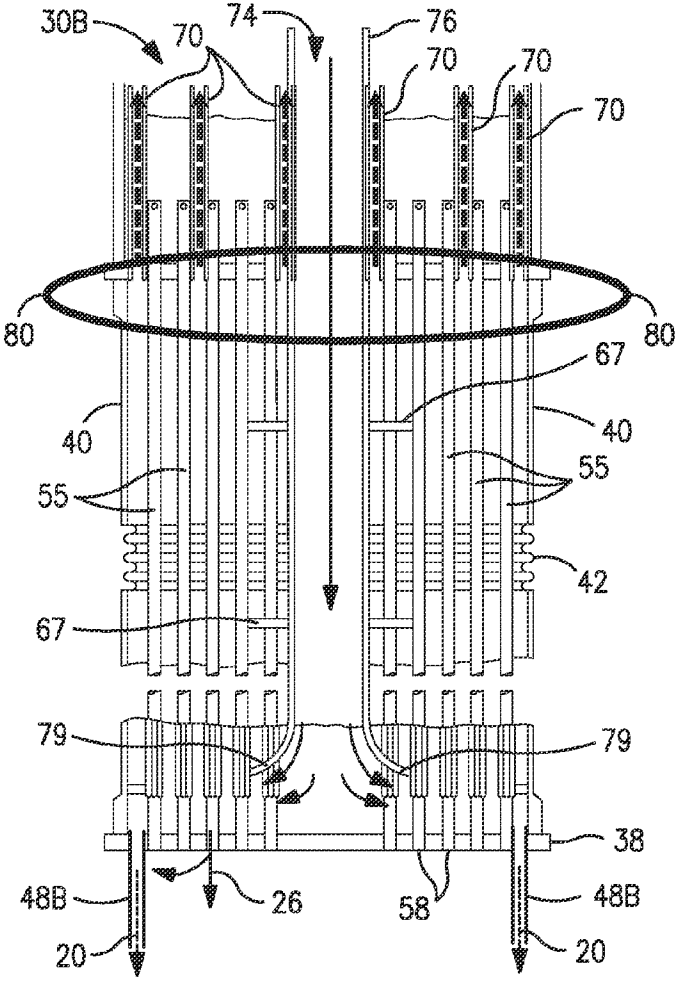
FIG. 10 is an elevational sectional view of still yet another embodiment of the condenser-reboiler module with a downflow type arrangement for boiling of a liquid oxygen stream and generally upward flow distribution of the nitrogen-rich vapor.
Figure 9:
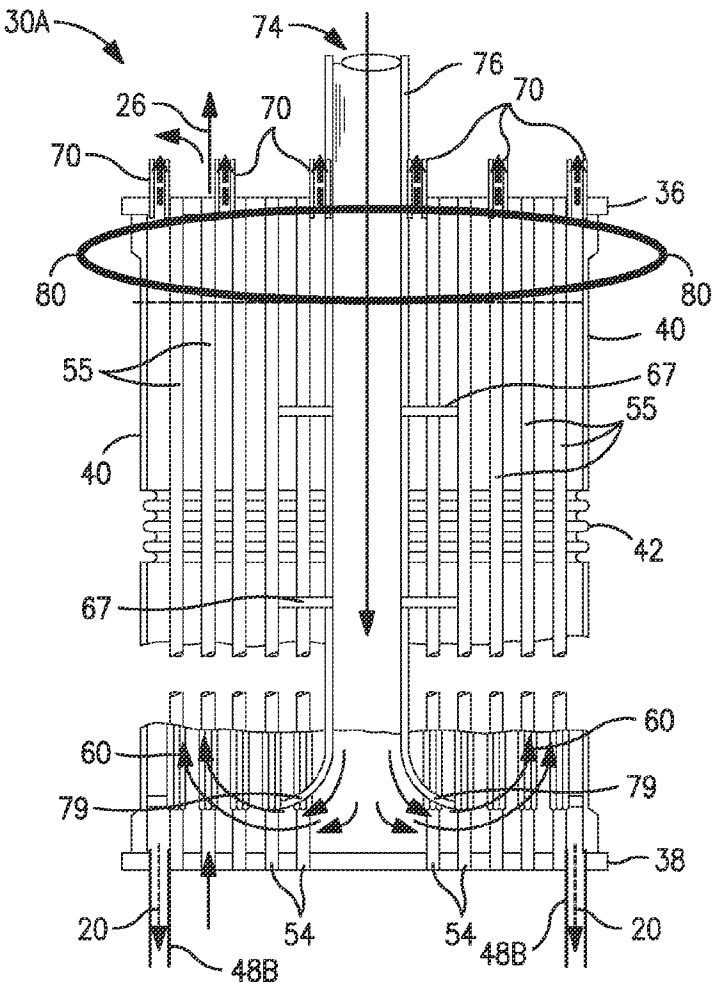
FIG. 9 is an elevational sectional view of still yet another embodiment of the condenser-reboiler module with a thermosyphon type arrangement for boiling of a liquid oxygen stream and generally upward flow distribution of the nitrogen-rich vapor.

In FIG. 9 and FIG. 10, there is shown yet another embodiment of the thermosyphon type heat exchanger 30A and downflow type heat exchanger 30B, respectively. As with the embodiments of FIGS. 5-8, the condensing medium inlet 74 is not located at or near the bottom of the condenser-reboiler module 14 and tubesheet 38 but rather at or near the side or the top of the condenser-reboiler module 14 and tubesheet 36. The condensing medium is preferably a nitrogen rich vapor that is directed from the upper portion of the higher pressure column via inlet conduit 76 within the shell 40 towards the lower portion of the heat exchanger 30A, 30B. At the end of the inlet conduit 76 there is a diffuser-like distributor structure 79 configured to radially distribute the flow of the nitrogen-rich vapor and diffuse the nitrogen-rich vapor flow proximate the lower portion of the shell 40. Upon release from the conduit 76, the nitrogen-rich vapor will flow in the generally upward and radially outward direction towards the condensing surfaces. One or more baffle plates 67 are shown centrally disposed within the shell 40 to deflect or urge the resulting upward flow of released nitrogen rich vapor within the shell 40 in an outward radial direction away from the conduit 76. The baffle plates 67 also serve as a central support member for the innermost array of condensing tubes.

The embodiments of FIGS. 3-16 all include a one or more vent passages 70 disposed at or near the top of the heat exchanger 30A, 30B and configured to continuously remove the accumulated non-condensables from within the one or more condenser-reboiler modules. In some embodiments, the vent passages 70 may be opened and/or closed with vent control valves (not shown) that are operatively associated with the vent passages 70. When opened, any non-condensable substances and accumulated non-condensables are discharged from the condenser-reboiler module 14. The illustrated vent passages 70 are shown disposed all along the top of the heat exchanger 30A, 30B and shown penetrating the tubesheet 36 from the central portion to the peripheral edges.

While the present invention has been characterized in various ways and described in relation to preferred embodiments, as will occur to those skilled in the art, numerous, additions, changes and modifications thereto can be made without departing from the spirit and scope of the present invention as set forth in the appended claims.

What is claimed is:

1. A condensation and vaporization system for an air separation unit comprising:

one or more condenser-reboiler modules having a housing defining a top, a bottom, one or more lateral sides, an upper portion, and a lower portion, the one or more condenser-reboiler modules disposed within a lower pressure column and configured to receive a condensing medium at a condensing inlet disposed at the top of the housing, an oxygen-rich liquid from the lower pressure column at an oxygen-rich liquid inlet disposed proximate the bottom of the housing, and further defining a condensate outlet proximate the bottom of the housing and an oxygen-rich effluent outlet disposed proximate the top of the housing;

a shell and tube heat exchanger disposed in the one or more condenser-reboiler modules and comprising two opposed tube sheets, a cylindrical shell connecting the two opposed tube sheets, an inlet conduit centrally and vertically disposed within the shell configured to direct the condensing medium from the condensing inlet to a location proximate a bottom of the cylindrical shell and a plurality of tubes extending between the two opposed tube sheets, the shell and tube heat exchanger configured to partially vaporize the oxygen-rich liquid flowing up within the plurality of tubes thereby forming an oxygen-rich effluent and condense the condensing medium within the cylindrical shell forming a condensate;

wherein the condensing medium enters the one or more condenser-reboiler modules at the condensing inlet, traverses through the inlet conduit and is released within the shell and tube heat exchanger in the condenser-reboiler modules at the bottom of the cylindrical shell and flows in an upward and radially outward direction within the cylindrical shell;

wherein non-condensables present in the condensing medium accumulate at the outer surfaces of the plurality of tubes and proximate the upper portion; and one or more vents disposed proximate the upper portion or top of the housing for the one or more condenser-reboiler modules and configured to remove the accumulated non-condensables proximate the outer surfaces of the plurality of tubes.

2. The system of claim 1 wherein the heat exchanger is a thermosyphon heat exchanger and the oxygen-rich liquid inlet is disposed proximate the bottom of the condenser-reboiler module and the oxygen-rich effluent outlet is disposed proximate the top of the housing for the one or more condenser-reboiler modules, and wherein the oxygen-rich liquid at the bottom of the lower pressure column is supplied to the condenser-reboiler module for re-boiling.

3. The system of claim 1 wherein the condensate outlet is disposed proximate the bottom of the housing for the one or more condenser-reboiler modules and concentrically around the condensing medium inlet.

4. The system of claim 1 wherein the condensate outlet is disposed proximate the bottom of the housing for the one or more condenser-reboiler modules and proximate the lateral side or peripheral edges of the housing.

5. The system of claim 1 wherein the condensing medium inlet is disposed at the top or the lateral side of the housing and directed via a conduit to the bottom of the housing for the one or more condenser-reboiler modules where the condensing medium is released.

6. The system of claim 1 further comprising a non-condensable recovery system coupled to the one or more vents and configured to purify and recover the removed non-condensables.

7. The system of claim 1 wherein the condensing medium is a nitrogen-rich vapor.

8. The system of claim 1 wherein the condensing medium is an air vapor.

* * * * *